US006821081B1

(12) United States Patent
Kurtz

(10) Patent No.: US 6,821,081 B1
(45) Date of Patent: Nov. 23, 2004

(54) LOADER WITH EXTENDING BUCKET AND COUNTER BALANCE

(76) Inventor: William C. Kurtz, 2187 State Rd. #87, St. Croix, WI (US) 54024-7851

( * ) Notice: Subject to any disclaimer, the term of this patent is extended or adjusted under 35 U.S.C. 154(b) by 439 days.

(21) Appl. No.: 09/072,241

(22) Filed: May 4, 1998

(51) Int. Cl.[7] ..... E02F 3/04
(52) U.S. Cl. ..... 414/800; 212/196; 414/719
(58) Field of Search ..... 414/719, 800, 414/696; 212/178, 195, 196

(56) References Cited

U.S. PATENT DOCUMENTS 2,538,000 A * 1/1951 Hoar et al. ..... 414/696 X
4,507,043 A * 3/1985 Flatau ..... 414/719
4,867,321 A * 9/1989 Montgon ..... 212/195 X
5,169,278 A * 12/1992 Hoechst et al. ..... 414/685
5,609,464 A * 3/1997 Moffitt et al. ..... 414/685
6,132,163 A * 10/2000 Andrews et al. ..... 414/686 X

* cited by examiner

*Primary Examiner*—Donald W. Underwood
(74) *Attorney, Agent, or Firm*—Albert W. Watkins

(57) ABSTRACT

A small loader machine of the skid-steered type having a counterweight to balance heavy loads in the loader bucket. The bucket is automatically extended forward as the counterweight is extended in the opposite direction so as to keep the machine always in reasonable balance.

11 Claims, 1 Drawing Sheet

LOADER WITH EXTENDING BUCKET AND COUNTER BALANCE

This invention pertains to mobile loaders both of the type steered by braking some wheels and not others so that the effect is called "skid-steered" and to more conventional loaders. This type of machine is in common use inside warehouse or factory settings where the machinery may be electrically powered and on farms and also where smaller buildings such as housing may be under construction. The machine, particularly the "skid steered" machine is compact and usually has a relatively short wheel base.

Because of the short wheel base, the load carrying device such as a loading bucket cannot be extended very far forward with much load or the machine may pitch forward. Thus, extension of the bucket cannot be far beyond the wheels, or, alternatively, the load in the bucket must be quite limited.

Current expedients to assist in solving the problem include simply adding weight to the end of the machine opposite the bucket or by extending the wheel base. This may require very heavy loads opposite the bucket in order to balance the movement of the bucket around the axles or otherwise may require a permanently extended arm carrying the counterweight. Such extension tends to cause a pitching rearward after the bucket is unloaded resulting in a relatively unsafe condition.

In the more conventional loader, the bucket is customarily carried very close to the front end of the machine and therefore, cannot reach any substantial distance from the machine. This can prove a disadvantage because of the inflexibility and the lack of reach.

By the present invention, the loader is kept as compact as possible for ease in maneuverability. But when the bucket is loaded, the arm of the bucket automatically extends away from the machine so as to reach further away from machine and therefore to allow loading at a greater distance from the machine. At the same time and by substantially the same mechanism, a counterweight opposite the bucket may be extended in a direction opposite to the extended bucket so that there is a reduced chance of a forward pitching of the machine. It should be noted that the result would be the same regardless of the type of machine and its wheel base. The heavier machine with a larger wheel base may still be subject to tilting if the load in the bucket is too heavy.

Figure 2:
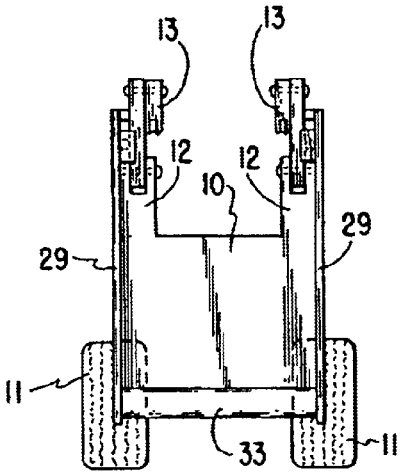
Figure 1:
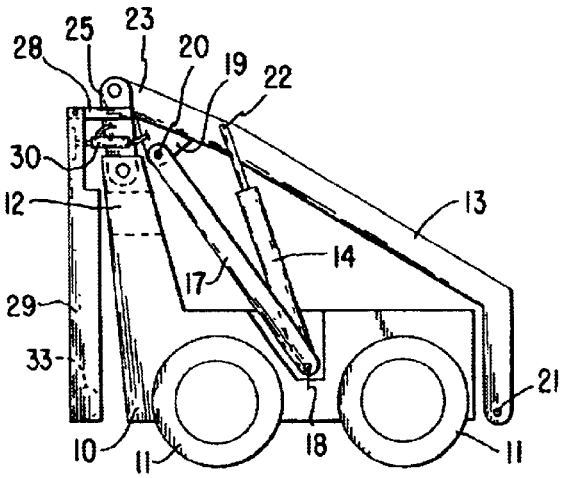
Figure 5:
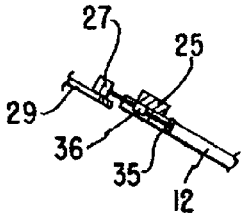
Figure 4:
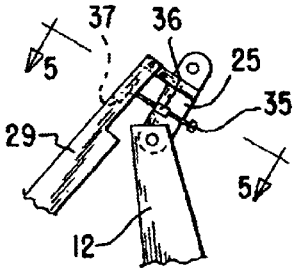
Figure 3:
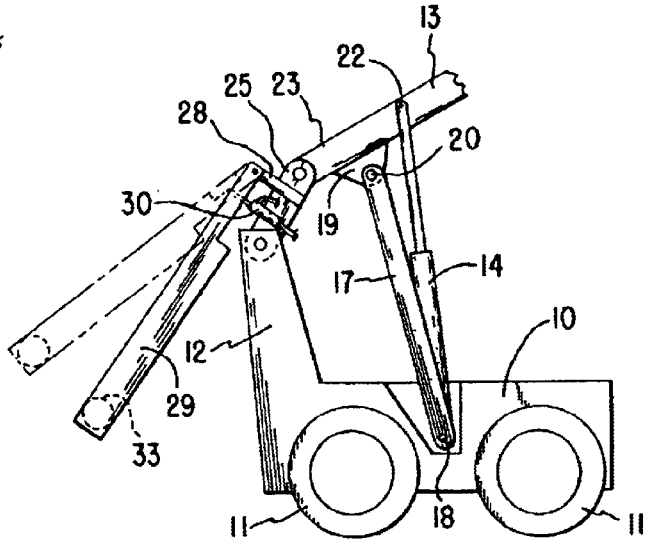

The actual mechanism and its use may be understood from the following description and the figures in which:

FIG. 1 is a side elevational view, partly diagrammatic, of a loader embodying the invention with the lifting arm in a lower position, FIG. 2 is a rear elevational view of the loader of FIG. 1, FIG. 3 is a view similar to FIG. 1 with the lifting arm in a raised position, FIG. 4 is a detailed partial view of an alternate adjustment for the counterweight, and FIG. 5 is a view from line 5—5 of FIG. 4.

DESCRIPTION

Briefly, this invention comprises an effective and compact counterweight system particularly adapted for a small loader sometimes characterized as a "skid-steered" loader having a relatively short wheelbase. The counterweight and the lifting arms are linked together so that the counterweight is extended while the lifting arms are lifting. The arms holding the counterweight may also have an adjustment to allow for loads which may be heavier than usual.

However, although the invention may be especially useful in a shorter wheel base machine, the extension of the bucket may also be useful for farm tractor type loaders and other devices having longer wheel base. The usual loader, having a bucket close to the front end of the operating machine has a limitation in the reach of the bucket to the dumping location that is solved by this invention.

More specifically and referring to the drawings, the system is adapted to be mounted on a loader 10 which is diagrammatically represented. There are many different varieties of such loaders, most of which are skid-steered and have relatively short wheelbases. But the loader may be a farm tractor type loader without deviating from the invention. Each has a separate type of seat for the operator. Some are powered by electric motors using batteries as a source of power; some are driven by internal combustion engines. This invention is adaptable to be fitted on any of them by reasonable adaptation.

There are certain features common to one particular group of such loaders. These loaders have wheels 11 spaced in tandem on a relatively short wheelbase. Each loader has a pillar 12, or its equivalent, to which the loader arms 13 are pivotally mounted. These arms run to the forward end of the loader where a bucket (not shown) may be pivoted to the arms and is adapted to carry a load of particulate or comminuted material. A cylinder/piston power unit 14 is pivoted to both the arms and the loader unit 10 to provide lifting force to raise the ends of the arms 13 and the bucket (or other load carrying device such as a pallet fork) to an upper position where such raising is desired. Often a bucket is raised to dump the loaded material into a truck or onto a pile. A pallet fork may be raised to stack the pallet and the goods on it. For other loaders, the pillar 12 may have to be supplied if some of the advantages of the system are to be realized.

It may be noted here that the power unit 14 is attached to the loader almost directly below the attachment to the arm 13. The arrangement allows a direct application of the power to the lifting function so that the weight lifting capacity is greatly enhanced over those loaders in which the unit lies nearly horizontally and thus has a relatively short lever arm on which to exert the force necessary to lift the load.

Two problems may appear in the ordinary system. Because the wheel base is short, there is a tendency to tip forward when the arms 13 are heavily loaded. Therefore, the arm must be relatively short to reduce the leverage tending to tip the machine or the load must be reduced. The novel linkage proposed by this invention alleviates both problems. It also alleviates a problem for those loaders used with farm tractors. That problem is one of reaching far enough ahead of the basic machine to dump the load in the bucket at the desired location. In the longer wheel base machine, the counterweight may not be as sorely needed.

The linkage includes a relatively long link 17 pivotally connected to the loader 10 at a first pivoted axis 18 which may be the same axis on which the power unit 14 is connected to the loader. At its other end, the link 17 is connected to the lifting arm 13. That connection is preferably made to a bracket 19 at a pivot axis 20 spaced from the connecting axis 22 of the power unit on the arms 13 and in a direction away from the end 21 at which the load carrier is attached.

The end 23 of the lifting arms 13 opposite the end 21 where the load carrier attachment is made is pivotally attached to a first end of a shorter link 25. The second end of the link 25 is pivoted to the pillar 12. Thus an irregular quadrilateral figure is formed by the loader 10 including its pillar 12 combined pivotally with the long link 17, a part of the lifting arm 13 and the shorter link 25. This quadrilateral, because of the pivotal connections can be moved by extension and retraction of the power unit 14. It should be noted that extension of the power unit will cause the long link or stabilizer arm 17 to force the arm 13 forward thus extending the arm further toward the front of the loader 10 and therefore will cause the load carrier to extend away from the loader thus increasing the leverage force tending to tip the loader forward.

In order to avoid that tipping, a counterweight arrangement is provided. This arrangement includes a bracket 28 permanently affixed to the shorter link 25. To this arm is pivoted a counterweight carrier arm 29. To control the pivoted position of the carrier arm 29 relative to the shorter link 25, an adjustment mechanism 30 may be used. The mechanism illustrated in FIGS. 1 and 3 comprises a simple hydraulic device attached between the shorter link 25 and the carrier 29. Thus, by extending the hydraulic device, the arm 28 can be further spaced from the short link 25.

Thus far the description has been of a simple mechanism. In practice two similar assemblies will be placed in parallel planes, one on each side of the loader as is common with such loaders. Therefore, a counterweight 33 can be carried between the parallel carrier arms 29. By spreading the arms rearward, as shown in FIG. 3, the counterbalancing force of the weight will be enhanced because of the added leverage.

Although the preferred embodiment has been described, it will be apparent that other means can be substituted for the hydraulic device 30. For example, as shown in FIGS. 4 and 5, a simple mechanical device such as a screw 35 threaded into a nut 36 affixed to the short link 25. The screw extends to abut a block 37 on the carrier arm 29 and thus can accomplish the same result as the hydraulic device 30.

Thus a relatively simple mechanism has been devised and demonstrated which will enhance the lifting and carrying possibilities of the ordinary small loaders. This enhancement includes a larger forward extension of the load while at the same time balancing that load by an automatically extended counterweight.

I claim as my invention:

1. A method of vertically raising a load from a first ground-level position to a raised unloading position and simultaneously shifting said load horizontally away from a mobile base to improve a horizontal extension of said load from said mobile base, comprising the steps of:

attaching a first pivotal arm adjacent a first end to said mobile base at a first position on said mobile base through a first arm pivot;

engaging said pivotal arm adjacent a second end distal to said first end with a load support at a first position on said load support through a second arm pivot;

coupling a second pivotal arm adjacent a first end to said mobile base at a second position on said mobile base spaced from said first position on said mobile base through a third arm pivot;

pivotally joining said second pivotal arm adjacent a second end distal to said first end with said load support at a second position on said load support between said load support first position and said load through a fourth arm pivot, thereby forming a quadrilateral linkage comprising said mobile base between said first and third arm pivots, said first and second pivotal arms, and said load support;

moving said first pivotal arm about said first arm pivot and said second pivotal arm about said third arm pivot to vertically raise said load from said first ground-level position to said raised unloading position;

horizontally shifting said load support responsive to and throughout said moving step in a direction corresponding to the direction of horizontal displacement between said load and said mobile base; and shifting a counterweight horizontally from said mobile base oppositely of said load support during said horizontally shifting step.

2. The method of claim 1 wherein said step of shifting a counterweight comprises rotating said first pivotal arm about said first arm pivot to simultaneously vertically lower and horizontally shift said second arm pivot and vertically raise and shift said counterweight oppositely to said second arm pivot.

3. A method of vertically raising a load from a first ground-level position to a raised unloading position and simultaneously shifting said load horizontally away from a mobile base to improve a horizontal extension of said load from said mobile base, comprising the steps of:

attaching a first pivotal arm adjacent a first end to said mobile base at a first position on said mobile base through a first arm pivot;

engaging said pivotal arm adjacent a second end distal to said first end with a load support at a first position on said load support through a second arm pivot;

coupling a second pivotal arm adjacent a first end to said mobile base at a second position on said mobile base spaced from said first position on said mobile base through a third arm pivot;

pivotally joining said second pivotal arm adjacent a second end distal to said first end with said load support at a second position on said load support between said load support first position and said load through a fourth arm pivot, thereby forming a quadrilateral linkage comprising said mobile base between said first and third arm pivots, said first and second pivotal arms, and said load support;

moving said first pivotal arm about said first arm pivot and said second pivotal arm about said third arm pivot to vertically raise said load from said first ground-level position to said raised unloading position;

horizontally shifting said load support responsive to and throughout said moving step in a direction corresponding to the direction of horizontal displacement between said load and said mobile base;

rotating said first pivotal arm about said first arm pivot operatively responsive to said moving step; and horizontally shifting said second arm pivot relative to said first arm pivot in said direction of horizontal displacement responsive to and throughout said rotating step.

4. A method of vertically raising a load from a first ground-level position to a raised unloading position and simultaneously shifting said load horizontally away from a mobile base to improve a horizontal extension of said load from said mobile base, comprising the steps of:

attaching a first pivotal arm adjacent a first end to said mobile base at a first position on said mobile base through a first arm pivot;

engaging said pivotal arm adjacent a second end distal to said first end with a load support at a first position on said load support through a second arm pivot;

coupling a second pivotal arm adjacent a first end to said mobile base at a second position on said mobile base spaced from said first position on said mobile base through a third arm pivot;

pivotally joining said second pivotal arm adjacent a second end distal to said first end with said load support at a second position on said load support between said load support first position and said load through a fourth arm pivot, thereby forming a quadrilateral linkage comprising said mobile base between said first and third arm pivots, said first and second pivotal arms, and said load support;

moving said first pivotal arm about said first arm pivot and said second pivotal arm about said third arm pivot to vertically raise said load from said first ground-level position to said raised unloading position;

horizontally shifting said load support responsive to and throughout said moving step in a direction corresponding to the direction of horizontal displacement between said load and said mobile base;

rotating said load support arm about said fourth arm pivot operatively responsive to said moving step; and horizontally shifting said fourth arm pivot relative to said second arm pivot in said direction of horizontal displacement responsive to and throughout said rotating step.

5. The method of vertically raising a load from a first ground-level position to a raised unloading position and simultaneously shifting said load horizontally away from a mobile base of claim 3 further comprising the steps of:

rotating said load support arm about said fourth arm pivot operatively responsive to said moving step; and horizontally shifting said fourth arm pivot relative to said second arm pivot in said direction of horizontal displacement responsive to and throughout said rotating step.

6. A method of vertically raising a load from a first ground-level position to a raised unloading position and simultaneously shifting said load horizontally away from a mobile base to improve a horizontal extension of said load from said mobile base, comprising the steps of:

attaching a first pivotal arm adjacent a first end to said mobile base at a first position on said mobile base through a first arm pivot;

engaging said pivotal arm adjacent a second end distal to said first end with a load support at a first position on said load support through a second arm pivot;

coupling a second pivotal arm adjacent a first end to said mobile base at a second position on said mobile base spaced from said first position on said mobile base through a third arm pivot;

pivotally joining said second pivotal arm adjacent a second end distal to said first end with said load support at a second position on said load support between said load support first position and said load through a fourth arm pivot, thereby forming a quadrilateral linkage comprising said mobile base between said first and third arm pivots, said first and second pivotal arms, and said load support;

moving said first pivotal arm about said first arm pivot and said second pivotal arm about said third arm pivot to vertically raise said load form said first ground-level position to said raised unloading position; and horizontally shifting said load support responsive to and throughout said moving step in a direction corresponding to the direction of horizontal displacement between said load and said mobile base;

wherein said step of moving further comprises the steps of:

extending a longitudinally extensible motive power source coupled between said mobile base and said load support causing said load support to vertically raise said load; and passing a longitudinal axis of said longitudinally extensible motive power source through vertical during said extending step.

7. A method of vertically raising a load from a first ground-level position to a raised unloading position and simultaneously shifting said load horizontally away from a mobile base to improve a horizontal extension of said load from said mobile base and still preserve a compact length of said base when said load is at or near said ground-level position for greater maneuverability in confined spaces, comprising the steps of:

attaching a first pivotal arm adjacent a first end to said mobile base at a first position on said mobile base through a first arm pivot;

engaging said pivotal arm adjacent a second end distal to said first end with a load support at a first position on said load support through a second arm pivot;

coupling a second pivotal arm adjacent a first end to said mobile base at a second position on said mobile base spaced from said first position on said mobile base through a third arm pivot;

pivotally joining said second pivotal arm adjacent a second end distal to said first end with said load support at a second position on said load support between said load support first position and said load through a fourth arm pivot, thereby forming a quadrilateral linkage comprising said mobile base between said first and third arm pivots, said first and second pivotal arms, and said load support;

moving said first pivotal arm about said first arm pivot to vertically lower and horizontally shift said second arm pivot in a direction corresponding to the direction of horizontal displacement between said load and said mobile base and moving said second pivotal arm about said third arm pivot to vertically raise said load from said first ground-level position to said raised unloading position; and horizontally shifting a counterweight operatively connected to said first pivotal arm responsive to said moving step in a horizontal direction opposite to said second arm pivot to maintain said mobile base in balance during said horizontal extension of said load from said mobile base.

8. The method of vertically raising a load from a first ground-level position to a raised unloading position and simultaneously shifting said load horizontally away from a mobile base of claim 7 wherein said first pivotal arm extends primarily vertically prior to said moving step and extends primarily horizontally subsequent to said moving step.

9. The method of vertically raising a load from a first ground-level position to a raised unloading position and simultaneously shifting said load horizontally away from a mobile base of claim 8 wherein said counterweight extends primarily vertically prior to said moving step and extends primarily horizontally subsequent to said moving step.

10. The method of vertically raising a load from a first ground-level position to a raised unloading position and simultaneously shifting said load horizontally away from a mobile base of claim 8 comprising the additional step of mechanically fastening said counterweight to said first pivotal arm.

11. The method of vertically raising a load from a first ground-level position to a raised unloading position and simultaneously shifting said load horizontally away from a mobile base of claim 8 comprising the additional step of adjusting an angle between said counterweight and said first pivotal arm.

* * * * *